US006975278B2

(12) United States Patent
Song et al.

(10) Patent No.: US 6,975,278 B2
(45) Date of Patent: Dec. 13, 2005

(54) MULTIBAND BRANCH RADIATOR ANTENNA ELEMENT

(75) Inventors: Peter Chun Teck Song, Hong Kong (CN); Ross David Murch, Hong Kong (CN)

(73) Assignee: Hong Kong Applied Science and Technology Research Institute, Co., Ltd., Hong Kong (CN)

( * ) Notice: Subject to any disclaimer, the term of this patent is extended or adjusted under 35 U.S.C. 154(b) by 36 days.

(21) Appl. No.: 10/377,129

(22) Filed: Feb. 28, 2003

(65) Prior Publication Data

US 2004/0169612 A1 Sep. 2, 2004

(51) Int. Cl.[7] ..... H01Q 1/38; H01Q 5/02; H01Q 19/30

(52) U.S. Cl. ..... 343/795; 343/819; 343/833; 343/834

(58) Field of Search ..... 343/702, 792.5, 343/795, 802–804, 833–836, 810, 812, 815, 817, 837, 852, 819, 857

(56) References Cited

U.S. PATENT DOCUMENTS 2,619,596 A * 11/1952 Kolster ..... 343/727
5,818,397 A 10/1998 Yarsunas et al.
5,867,131 A 2/1999 Camp, Jr. et al.
6,057,805 A 5/2000 Harrington

FOREIGN PATENT DOCUMENTS

JP 11168323 6/1999

OTHER PUBLICATIONS

International Search Report issued for PCT/IB2004/000904, dated Sep. 2, 2004.

* cited by examiner

*Primary Examiner*—Michael C. Wimer
(74) *Attorney, Agent, or Firm*—Fulbright & Jaworski LLP

(57) ABSTRACT

Disclosed are systems and methods which provide multi-band antenna elements using multiple radiating branches interconnected with a feed plate, thereby providing a multi-band antenna element having a single feed. Additionally or alternatively, a wide band antenna configuration is provided utilizing multiple radiating branches of a multi-band antenna element of the present invention. Embodiments utilize one or more reflectors, such as to provide directivity and/or radiation pattern shaping, including utilizing one or more radiating branches of a multi-band antenna element as a reflector for another one or more radiating branches of the multi-band antenna.

31 Claims, 10 Drawing Sheets

MULTIBAND BRANCH RADIATOR ANTENNA ELEMENT

TECHNICAL FIELD

The invention relates generally to wireless communications and, more particularly, to multi-band antenna configurations.

BACKGROUND OF THE INVENTION

Various antenna element and antenna array configurations are utilized in wireless communications today. The dipole antenna, for example, is one of the most commonly encountered antenna configurations today. Their simplicity makes them relatively inexpensive and easy to build and deploy. As such, the dipole antenna is probably the most widely used form of antenna element in various mobile and base station installations.

Generally speaking, a dipole antenna element gives only 2.13 dBi of gain. Accordingly, many current manufacturers of wireless systems will use a pair of dipoles, such that the gain increases to about 5 dBi. For example, an antenna array may be configured in which pairs of dipole antenna elements are disposed above a ground plane to provide a desired level of gain and a radiation pattern having a desired contour/directivity.

The patch antenna is another antenna configuration found in wireless communication systems today. A patch antenna element comprises a piece of metal plate sized according to a desired operating frequency band. Although providing increased gain over that of a dipole antenna element, patch antenna elements are fairly large in size, as compared to a dipole antenna element responsive to the same frequency band. Moreover, patch antennas often require complicated manufacturing processes and/or assembly techniques in order to provide a useful antenna array.

It is sometimes desirable to provide a base station or access point having dual-band performance. For example, it may be desirable to accommodate wireless communications operating according to different protocols, such as advanced mobile phone service (AMPS) and personal communication service (PCS), utilizing different frequency bands, such as 800 MHz and 2.4 GHz. Additionally or alternatively, particular wireless devices may utilize more than a single frequency band, such as to access more than a single service. For example, depending on the services required, a wireless device may have an operating frequency of 2.4 GHz and 5.2 GHz. As such, antennas should be provided which are efficient in these two bands in order to provide optimum transmission and reception of radio signals.

One prior technique for providing a dual-band antenna configuration is to provide an antenna array aperture having antenna elements responsive to each such band interleaved therein. For example, dipole elements responsive to a first frequency band may be disposed in columns having dipole elements responsive to a second frequency band, therebetween. Such a configuration effectively provides two single band antenna systems in a single antenna array. Accordingly, a relatively large number of antenna elements are utilized and a relatively complex antenna configuration results. Moreover, the antenna feed network in such a dual-band configuration may be complex or otherwise undesirable. For example, separate low loss (and expensive) antenna feed cables may be required by each such interleaved antenna array.

Alternatively, dual-band dipole antenna elements having a single feed may be realized using a load. Specifically, a load may be placed in each element of the dipole, to act as a low or high impedance at the respective frequency of interest, to provide dual-band performance. However, frequency optimization often results in adjusting current paths and, in most cases, involves impedance matching of the required bands. Such dual-band dipole elements can be relatively expensive and complicated to design and produce.

Another technique for providing a dual-band antenna configuration has been to utilize the aforementioned patch antenna elements. For example, different modes may be set on a patch antenna to give it dual-band performance. However, the use of such dual-band modes further complicates the design and manufacture of such elements. Moreover, such antenna elements remain relatively large. Accordingly the use of patch antenna elements may not be desirable in particular dual-band systems.

BRIEF SUMMARY OF THE INVENTION

The present invention is directed to systems and methods which provide multi-band antenna elements using multiple radiating branches interconnected with a feed plate, thereby providing a multi-band antenna element having a single feed. For example, the feed plate of a preferred embodiment multi-band antenna element comprises a triangular plate interconnecting multiple radiating branches.

According to embodiments of the present invention, frequency separation between resonate frequencies of the multi-band antenna element are relatively small, such as on the order of 1.2 times. According to other embodiments of the present invention, frequency separation between resonate frequencies of the multi-band antenna element are relatively large, such as on the order of 2.5 times. Preferably, each frequency band of the antenna elements can be optimized and/or adjusted by varying the respective radiating branch of the multi-band element.

Additionally or attentively, a wide band antenna configuration is provided according to embodiments of the present invention utilizing multiple radiating branches of a multi-band antenna element of the present invention. For example, one embodiment of the present invention utilizes a rectangular or square shaped feed plate configuration to interconnect multiple radiating branches, thereby resulting in broadband behavior. Preferably, the frequency band of the antenna elements can be optimized and/or adjusted by varying the radiating branches of the multi-band element in such a broad band configuration.

Embodiments of the present invention utilize one or more reflectors, such as to provide directivity and/or radiation pattern shaping. For example, embodiments of the present invention may utilize one or more radiating branches of a multi-band antenna element as a reflector for another one or more radiating branches of the multi-band antenna. Additionally or alternatively, ground plane surfaces may be utilized as reflectors according to embodiments of the invention.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

In understanding the concepts and advantages of embodiments of the present invention, a discussion of various prior art antenna element configurations is helpful. Accordingly, some detail with respect to prior art antenna configurations, such as information with respect to dipole antenna elements, is provided hereinbelow.

Figure 1A:
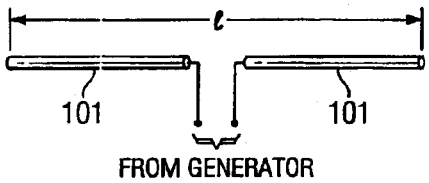
FIG. 1A (PRIOR ART)
FIGS. 1A–1C show various prior art dipole antenna element configurations.

A dipole is formed by a pair of balanced transmission lines, opened-out into a twin colinear line (poles 101) as shown in FIG. 1A. Its radiation pattern, radiation resistance and directivity are critically dependent upon length (l). A widely accepted optimum length is the half-wave dipole configuration ($l=\frac{1}{2}\lambda$) with a fundamental radiation pattern resembling a doughnut shape. This is a result of sinusoidal current vanishing at end points of the dipole. In other words, the configuration is limited to a single resonant frequency with the fundamental radiation pattern, dictated by its physical resonant length l. Gain of such dipole antennas has been measured and calculated at about 2.13 dBi.

Operating the dipole at a frequency higher than that for which the dipole's length corresponds is usually not practical as the number of radiation lobes increases, and power is radiated in a spread of several directions. Accordingly, the aforementioned dipole antenna element configuration presents a challenge with respect to controlling the radiation pattern if a multi-band implementation were attempted.

Figure 1B:
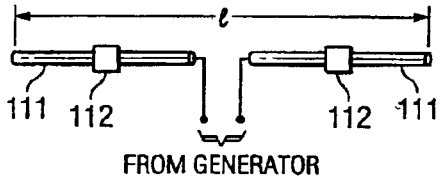
FIG. 1B (PRIOR ART)

Dual-band dipoles with a single feed for both bands may be realized using a load disposed in the poles acting as a low or high impedance, at the respective frequency of interest. A dipole configuration implementing loads 112 in poles 111 is shown in FIG. 1B. The aforementioned loads can be realized using several methods, such as structural perturbation using slots and meanders, adding parasitic or even passive components. Frequency optimization of such dual-band dipole configurations often involves adjusting current paths, and in most cases, impedance matching of the required bands.

Figure 1C:
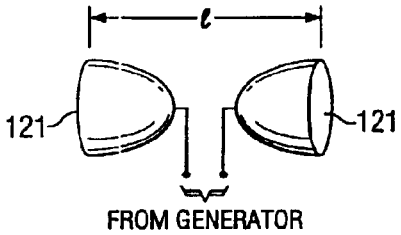
FIG. 1C (PRIOR ART)

The impedance bandwidth of dipole antenna is usually limited by the physical diameter of the antenna element. Accordingly, by increasing the diameter of the radiating element, impedance bandwidth can generally be improved. One design to increase impedance bandwidth employs a gradual taper as shown in FIG. 1C. Specifically, poles 121 are tapered in diameter from the feed coupling to the end points of the dipole. As can be appreciated from the illustration in FIG. 1C, increasing the diameter of the dipole in this manner results in a 3-dimensional volume, making low cost manufacturing techniques, such as planar etching, difficult. Accordingly, 2-dimensional designs, such as a bow-tie antenna configuration requiring a wideband balun and impedance match technique, have been implemented. Similarly, traces of a printed dipole configuration have been widened to mimic a larger diameter wire.

Figure 2A:
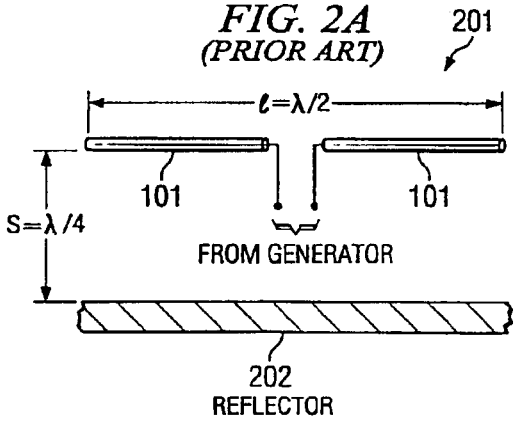
FIG. 2A (PRIOR ART)
FIGS. 2A and 2B show a prior art corner reflector dipole antenna system configuration.

Reflectors are often used to control the radiation pattern of antennas, to increase the antenna directivity, and/or to increase the gain of the antenna. For example, when a radiating element is placed over a large enough reflector, backward radiation can be eliminated. One common technique is to implement quarter wave spacing ($S=\frac{1}{4}\lambda$) between a reflector (ground plane 202) and a radiating element (dipole 201, comprising poles 101), as shown in FIG. 2A. The aforementioned quarter wave spacing results in the fields radiated by the antenna element adding constructively (in phase), thereby providing increased broadside (side of dipole 201 opposite ground plane 202) radiation amplitude.

Figure 2B:
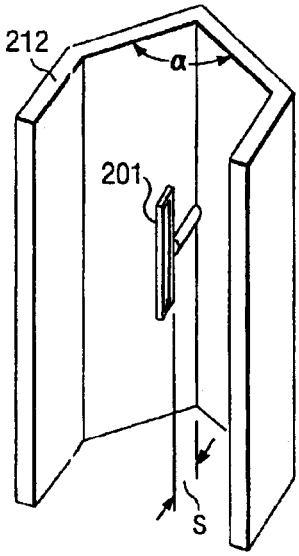
FIG. 2B (PRIOR ART)

Radiation patterns can be further controlled with a folded reflector as shown in FIG. 2B. Specifically, ground plane 212 of FIG. 2B has been folded along an axis parallel to dipole 201, where the driving element is placed at the center of the fold distance S from the fold surface and $\alpha$ denotes the angle between the folded surfaces. Such a configuration is known as an active corner reflector. The effectiveness of such a reflector configuration is determined by the quality of the constant phase front at the aperture and, as such, reflector and feed placement is frequency dependent. As spacing, S, approaches 1λ, progression of the reflected fields with respect to the feed antenna results in phase cancellation, or destructive combining, causing a broadside null.

Figure 3A:
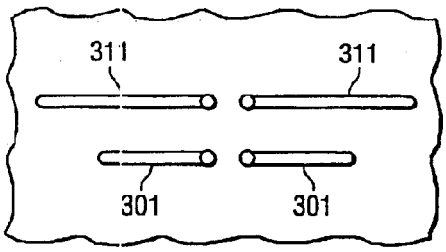
FIGS. 3A–3C show radiating branch configurations of multi-band antenna elements according to embodiments of the present invention.
Figure 3B:
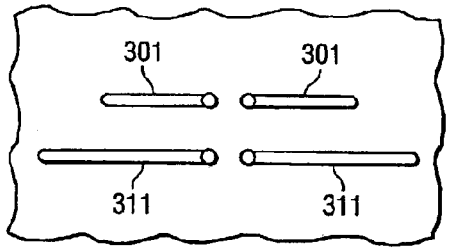

Embodiments of the present invention address challenges posed by implementation of multi-band antenna configurations by implementing a dipole antenna element configuration in which multiple radiating branches are utilized. Directing attention to FIGS. 3A and 3B, two multi-band dipole antenna element configurations are shown including radiating branches 301 and 311. Specifically, the configuration of FIG. 3A shows a multi-band dipole antenna element configuration in which radiating branches 301, associated with a highest frequency band or high end of a wideband frequency band, are disposed beneath or behind radiating branches 311, associated with a lowest frequency band or low end of a wideband frequency band. Conversely, the configuration of FIG. 3B shows a multi-band dipole antenna element configuration in which radiating branches 311, associated with a lowest frequency band or low end of a wideband frequency band, are disposed beneath or behind radiating branches 301, associated with a highest frequency band or high end of a wideband frequency band. These particular configurations will be discussed in further detail hereinbelow.

Frequency separation of the resonant frequencies associated with the radiating branches of antenna elements of the present invention can be quite minimal, such as on the order of the higher frequency being approximately 1.2 times the lower frequency, or can be quite large, such as on the order of the higher frequency being approximately 2.5 times the lower frequency. According to preferred embodiments of the present invention, the frequency band (broadband configuration) or frequency bands (multi-band configuration) of the antenna element can be easily optimized or altered by varying the respective radiating branches.

Figure 3C:
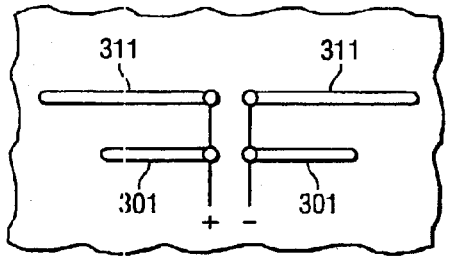

Preferred embodiments of the present invention utilize a single feed for multi-band or broadband operation. For example, a single balanced feed as represented in FIG. 3C may be utilized with respect to a preferred embodiment dipole antenna element. Although it is possible to feed the radiating branches of an antenna element of the present invention directly with a transmission line in series, such a feed configuration generally results to poor matching conditions. The separation between the feed lines, as well as the separation between the radiating branches, also affects the matching and radiation properties.

Figure 4A:
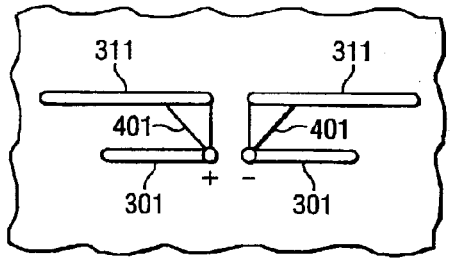
FIGS. 4A–4E show radiating branch configurations of FIGS. 3A–3C including signal feed plates according to embodiments of the present invention.
Figure 4B:
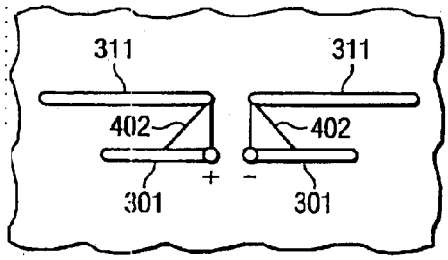
Figure 4C:
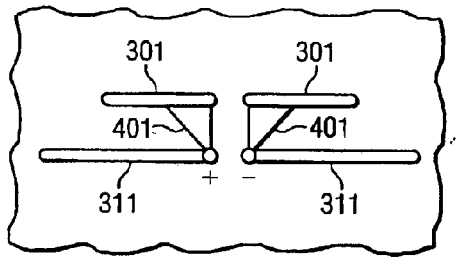
Figure 4D:
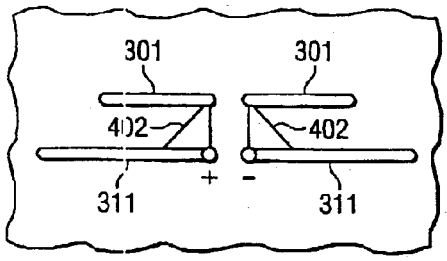

Embodiments of the present invention utilize a signal feed technique in which the radiating branches are joined together with a conductive plate. Various configurations of signal feed plates (i.e., conductive plates having relatively large surface areas as compared to the radiating branches) as used in multi-band antenna elements of the present invention are shown in FIGS. 4A–4E. Specifically, FIGS. 4A and 4B show a radiating branch configuration corresponding to that of FIG. 3A in which triangular signal feed plates 401 and 402, respectively, are implemented to couple radiating branches 301 and 311 having different resonate frequencies. FIGS. 4C and 4D show a radiating branch configuration corresponding to that of FIG. 3B in which triangular signal feed plates 401 and 402, respectively, are implemented to couple radiating branches 301 and 311 having different resonate frequencies.

Signal feed plates of the present invention create a loading effect with respect to the antenna element which improves impedance matching of the bands of the antenna. Accordingly, signal feed plates may be sized, shaped, and/or oriented to optimize impedance matching, as well as other operating characteristics. For example, selection of a particular triangular signal feed plate 401 or 402, wherein the orientation of the triangular shape is reversed, may be based upon a particular orientation resulting in a best band and/or impedance match.

Figure 4E:
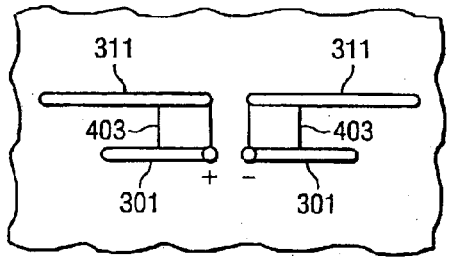

FIG. 4E shows another configuration of a signal feed plate. The configuration of FIG. 4E, using square signal feed plate 403, provides an ultra-wideband antenna element as the two radiating branches are seen to be merged as a single element. This broadband effect is due to the modes of the dipoles being degenerated and hence fused together. Specifically, as the size of the signal feed plate is increased, the resonance bands diffuse, effectively de-Qing the antenna element so that the bands become broader.

It should be appreciated that the antenna element structure of embodiments of the present invention may readily be printed on a printed circuit board (PCB) substrate, such as FR4, to provide multi-resonance operation using multiple radiating branches. Such PCB antenna element configurations may include parasitic elements, such as reflectors and/or directors, to improve operating characteristics. Such antenna element designs are an excellent candidate for multiple band cellular base station array antenna designs.

The multi-frequency operation of a multi-band antenna element of preferred embodiments can be tuned by varying the lengths of the appropriate radiating branches. However, for the outer radiating branches (radiating branches 311 in FIGS. 4A and 4B, radiating branches 301 in FIGS. 4C and 4D, and radiating branches 311 in FIG. 4E) current is feed between the capacitive effects of the signal feed plates, resulting in an upward resonance frequency shift. That is, not only will currents flowing within the inner and outer radiating branches define the operating frequencies (multi-band configuration) or broadband match (broadband configuration), but capacitive effects will also generally result in some shift in resonance frequency. Moreover, the dimensions of signal feed plates of the present invention will typically affect operation frequencies of the resulting multi-band antenna element and, conversely, the dimensions of signal feed plates of the present invention may be determined by design criteria with respect to the separation of the radiating branches.

Figure 5:
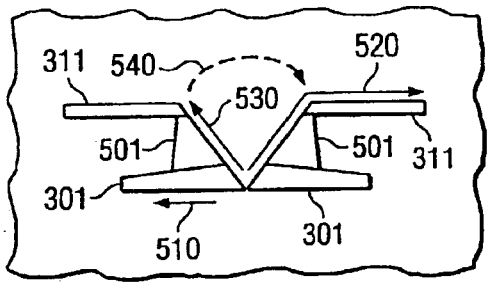
FIG. 5 shows an embodiment of a multi-band antenna element according to the present invention.

The aforementioned capacitive effects associated with signal feed plates of the present invention may be mitigated by utilizing a configuration in which the parallel plate currents are tapered or spaced away from each other, as shown in FIG. 5, to split this coupling effect apart. In the embodiment of FIG. 5, the higher frequency radiating branches (i.e., the shorter radiating branches) are disposed to the inside of the antenna element (e.g., toward the signal generator) and the lower frequency radiating branches (i.e., the longer radiating branches) are disposed to the outside of the antenna element (e.g., above or in front of the higher frequency radiating branches), similar to the configuration shown in FIG. 4D. However, in the embodiment of FIG. 5, triangular signal feed plates 501 are tapered away from each other to reduce the coupling effect, thereby providing a tapered bore signal feed plate configuration. Alternative embodiments may use a different tapered bore signal feed plate configuration, such as a trapezoid or curved configuration, to provide desired operating characteristics, such as broadband operation.

Arrow 520 of FIG. 5 shows current flow associated with an outer radiating branch (here a lower frequency branch)

and arrow 510 of FIG. 5 shows current flow associated with an inner radiating branch (here a higher frequency branch). These current paths determine the resonance frequencies associated with the radiating branches of the illustrated embodiment. Accordingly, the tapered bore signal feed plate configuration of FIG. 5 provides multi-band operation and the frequency of operation can be tuned by adjusting the length of the appropriate radiating branches, as described above. However, the tapered bore signal feed plate configuration also increases the bandwidth of each resonance of the antenna by reducing unwanted stored energy.

Another mode, which in effect is a frequency independent mode, is obtained according to preferred embodiments by optimizing the antenna structure resulting from tapered bore signal feed plate 501. A frequency independence effect is attributed to the smooth scaling factor of the structure between tapered bore signal feed plates 501, providing an aperture as shown below arrow 540, representing the fringing field associated with current flow of arrow 530. The lowest resonance generated by this mode is determined by aperture forming the fringing field. This electrical property is similar to a horn or tapered slot type antenna.

Figure 6A:
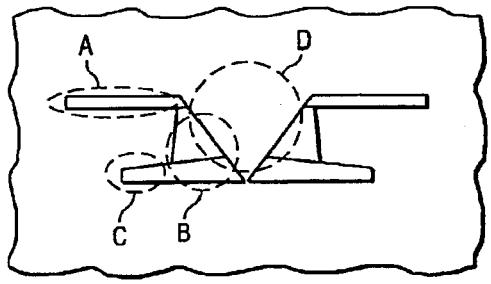
FIGS. 6A–6E illustrate parameters and properties useful in configuring multi-band antenna elements of the present invention for desired operational characteristics.
Figure 6B:
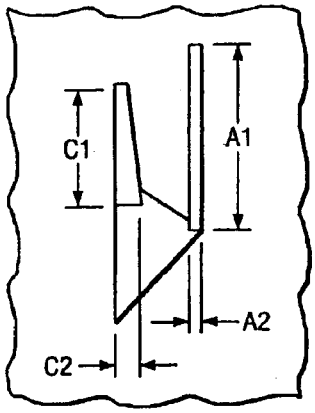
Figure 6C:
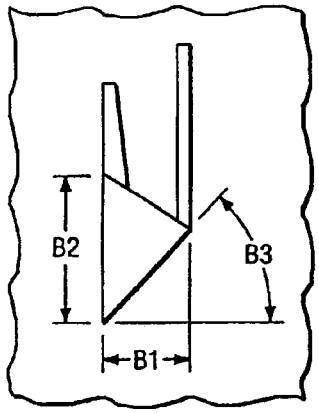
Figure 6D:
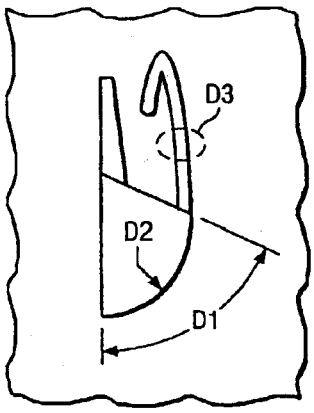

As mentioned above, the length of the radiating branches as well as the size, shape, and/or geometry of signal feed plates of the present invention are preferably taken into consideration when designing and/or tuning an antenna element of embodiments for operation at a particular frequency or frequencies. Four primary generic design parameters utilized according to preferred embodiments of the present invention are shown in FIG. 6A, denoted as A, B, C and D. Depending on the structural configuration of these parameters, different resonance and operating modes can be realized.

The operating characteristics associated with the outer radiating branch (here a lower frequency radiating branch) are primarily a function of parameters A and B, whereas the operating characteristics associated with the inner radiating branch (here a higher frequency radiating branch) are primarily a function of parameters B and C. Specifically, parameters A and C tune the individual resonances associated with the outer and inner radiating branches, respectively, while the size, shape, and/or geometry (parameter B) of the signal feed plate matches the radiating branches. For a frequency independent mode operation, parameters of A, B and D may be optimized.

FIGS. 6B–6E show various properties of parameters A, B, C, and D. Structural variations of the antenna elements may be implemented according to the particular properties of FIGS. 6B–6E. A summary of effects associated with the various properties are shown in the table below.

| | |
|---|---|
| A1 + B1 + B3 | Direct impact on lower band resonance frequency |
| C1 + B2 | Direct impact on upper band resonance frequency |
| A2 | Bandwidth control of lower band |
| C2 | Bandwidth control of upper band |
| A3 + A4 | Size reduction of lower band antenna |
| B1 | Separation between elements A and C |
| B3 | Angle affecting coupling |
| B2 + B3 | Optimize bandwidth and impedance match |
| D1 | Improves impedance match |
| D2 | Frequency independent wave guide, usually defined by an exponential scaling factor |
| D3 | Low frequency termination |

Although descriptions provided in the above table are with reference to low and high frequency radiating branches disposed in the configuration of FIG. 6A, it should be appreciated that the parameters and properties described are similarly effective with respect to other multi-band antenna element configurations. For example, where lower frequency radiating branches are disposed beneath or behind higher frequency radiating branches, the low/high frequency references provided in the table above would be transposed.

From the above, it is apparent that the resonate frequencies may be independently tuned or controlled by selection of properties A1 and C1 (C1 for the higher frequency and A1 for the lower frequency). Moreover, the lower resonant frequency is also determined by properties B1 and B2 because these properties affect the current path associated with the lower frequency radiating branch. Properties A2 and C2 affect the individual radiating branch bandwidth. That is, generally speaking the larger the properties A2 and C2, the larger radiation branch bandwidth.

The angle of property B3 is associated with the separation of the two current paths in a dipole configuration, thus the larger the angle more that coupling is reduced. Moreover, property B3 affects the matching between the multiple resonate bands of the multi-band antenna element. Property B3 also has some broad banding effect, because the signal feed plate reduces the Q-factor of the antenna, as well as being associated with another resonance mode, as discussed above with respect to FIG. 5, giving an ultra wide frequency independent mode. Properties B1, B2, and B3 determine the aperture the of ultra wide frequency independent mode, which determines the operating frequency of that mode.

Parameters D1 and D2 define a curved signal feed plate embodiment providing operation approximating that of a tapered slot antenna. This taper slot will act as a frequency independent wave guide, similar to that described above with respect to FIG. 5.

Figure 6E:
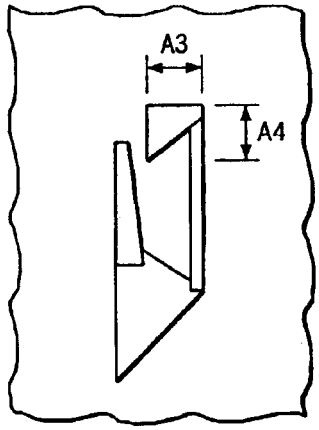

Properties A3 and A4 are utilized according to an embodiment for size reduction. For example, property A1, being associated with the lower resonance frequency, may be quite long. Accordingly, the radiating branch may be folded, according to properties A3 and A4, to form a radiating branch which is reduced in size. In the embodiment of FIG. 6E, the overall length of such a radiating branch may be shortened by approximately the length of property A3. The taper associated with property A4 may be selected to provide a loading effect, tune the resonate frequency and/or improve the bandwidth. Of course, various embodiments may be utilized in reducing radiating element size, such as the folded configuration of FIG. 6D.

According to conventional wisdom, higher frequency elements would be placed in front of physically larger, lower frequency elements. One reason for such a configuration according to conventional wisdom is that the larger element blocks or "shorts out" the electromagnetic waves of the shorter wavelength. In such a situation, the higher frequency electromagnetic waves are not able to propagate past the larger element. Instead, the larger element may effectively form a reflector for the higher frequency element.

Embodiments of the present invention take advantage of the above phenomena to optimize broadside radiation. Specifically, depending on the separation between the elements, resultant phase of the radiated fields can be constructively combined to optimize a broadside radiation pattern. However, contrary to conventional wisdom, preferred embodiments of the present invention dispose the radiating branches such that higher frequency radiating branches are disposed beneath or behind lower frequency radiating branches.

Figure 7A:
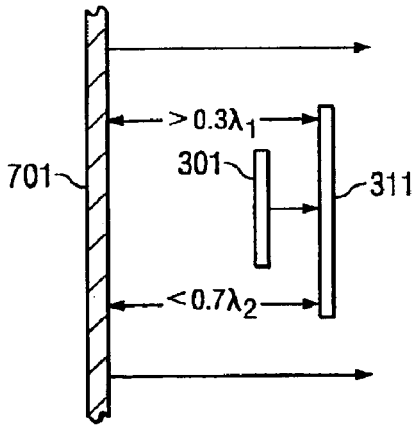
FIGS. 7A and 7B show a sub-reflector radiating branch configuration of multi-band antenna elements according to embodiments of the present invention.
Figure 7B:
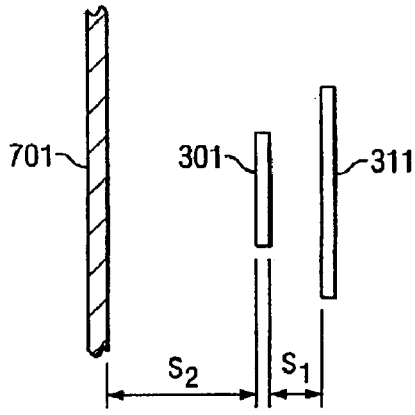

Directing attention to FIGS. 7A and 7B, a preferred embodiment configuration for optimizing broadside radiation where higher frequency radiating branches are disposed beneath or behind lower frequency radiating branches is shown. Specifically, radiating branch 311, having a lower resonate frequency as discussed above, is disposed as an outer radiator and radiating branch 301, having a lower resonate frequency as discussed above, is disposed as an inner radiator. It should be appreciated that, although a preferred embodiment of the present invention provides a dipole antenna element configuration, the illustration of FIGS. 7A and 7B have been simplified to show only a single pole of each radiating branch.

Also shown in FIGS. 7A and 7B is reflector 701, such as may comprise a ground plane. Although simplified for illustration in FIGS. 7A and 7B, reflector 701 of a preferred embodiment comprises a folded reflector. For example, reflector 701 may provide a corner reflector configuration, such as by providing a single fold, having an axes parallel to and directly behind radiating branches 301 and 311, such that sides of reflector 701 are disposed at an angle of approximately 45°. Of course, angles other than 45° may be utilized with respect to a reflector, such as any angle less than 180°, if desired. Other embodiments of reflector 701 may comprise multiple folds, such as shown in FIG. 2B. Of course, configurations of reflector 701 may be utilized according to alternative embodiments which do not include folded surfaces. For example, reflector 710 may comprise an element substantially corresponding to the shape of the radiating branches, although being longer than the longest radiating branch in order to provide a reflector thereto.

Although not shown in FIGS. 7A and 7B for simplification, radiating branches 701 and 711 are preferably coupled using a signal feed plate, such as those described above. Moreover, although not specifically illustrated in FIGS. 7A and 7B, it should be appreciated that the radiating branches may be configured to provide desired operating characteristics, such as by adjusting properties of parameters A, B, C, and/or D, as discussed above.

The radiating branch configuration of FIGS. 7A and 7B, wherein a higher frequency radiating branch is disposed beneath or behind a lower frequency radiating branch, enables a reflector to be used effectively for each such frequency. Specifically, reflector 701 provides a reflector for directing radiation fields associated with radiating branch 311 in the antenna broadside direction. Accordingly, radiation fields propagating from radiating branch 311 in the direction of reflector 701 will be reflected from reflector 701 to combine with fields radiated from radiating branch 311 in the antenna broadside direction to provide a wave front propagating from the antenna broadside. Additionally, radiating branch 311 and reflector 701 provide reflectors for directing radiation fields associated with radiating branch 301 in the antenna broadside direction. Radiation fields propagating from radiating branch 301 in the direction of radiating branch 311 will be reflected from radiating branch 311 to combine with fields radiated from radiating branch 301 in the direction of reflector 701. The combined radiation fields, propagating toward reflector 701, will be reflected from reflector 701 to provide a wave front propagating a wave front propagating from the antenna broadside.

In the embodiment illustrated in FIGS. 7A and 7B, radiating branch 311 acts as a sub-reflector with respect to radiating branch 301. Reflector 701 acts as a reflector with respect to both radiating branch 301 and radiating branch 311.

The configuration of FIGS. 7A and 7B, wherein radiating branch 311 acts as a sub-reflector with respect to radiating branch 301, provides a multi-band antenna element in which the gain of each band is quite similar. That is, the gain associated with the lower resonate frequency radiating branch is similar to the gain associated with the higher resonate frequency radiating branch. It should be appreciated that, in most dual-band antenna designs available in the art today, the gain of one band typically substantially different than the gain of the other band. For example, the use of different sized radiating elements in conventional dual-band configurations results in very different antenna apertures associated with each such band. In a dual-band patch antenna, for example, the patch elements associated with the higher frequency and the lower frequency are very different in size, thickness, and feed paths. Dual-band dipole antenna configuration have similar differences, although perhaps not as readily apparent from visual inspection. These differences result in the creation of different radiation apertures, and thus the gain is different between the two bands. Moreover, the radiation mechanism in one band is typically different from the other, so the current in one band has one mode and the current in the other band follows a different mode. These two modes have different gains associated therewith. However, preferred embodiments of the present invention, implementing a sub-reflector configuration as illustrated in FIGS. 7A and 7B, provide multi-band operation in which the gains of the multiple bands are substantially balanced.

As can be appreciated from the above discussion, spacing between the radiating branches affects the phased combining of radiated fields with reflected radiation fields. An equation for determining an optimum spacing between the radiating branches illustrated in FIGS. 7A and 7B is provided below as equation (1).

$$S_2 = x\left\{\frac{\lambda_1}{2} - \left(S_1 + \frac{\lambda_2}{2}\right)\right\} + \frac{\lambda_2}{2} \tag{1}$$

Where $S_1$ is the separation between radiating branch 301 and 311 (see FIG. 7B), $S_2$ is the separation between radiating branch 301 and reflector 701 (see FIG. 7B), $\lambda_1$ is the resonate frequency of radiating branch 311, $\lambda_2$ is the resonate frequency of radiating branch 301, and x is a natural number.

Separation distance $S_1$ is preferably optimized for reflection of fields radiated from radiating branch 301, Accordingly, $S_1$ of a preferred embodiment of the present invention is a factor of radiating branch 301's wavelength, $\lambda_2$. The position of reflector 701 with respect to the radiating branches as a function of resonate frequency wavelength (Ratio_$\lambda_1$ for radiating branch 311 and Ratio_$\lambda_2$ for radiating branch 301) may be given as set forth in equations (2) and (3) below.

$$\text{Ratio_}\lambda_1 = \frac{S_1 + S_2}{\lambda_1} \tag{2}$$

$$\text{Ratio_}\lambda_2 = \frac{S_2}{\lambda_2} \tag{3}$$

According to a preferred embodiment, the optimum position of reflector 701 with respect to each radiating branch lies between 0.25 to 0.7 of their respective wavelengths.

Embodiments of the present invention additionally or alternatively use director elements, such as to increase the antenna gain with respect to each band. Directing attention to FIG. 8, an embodiment in which the radiating branch configuration of FIGS. 7A and 7B has been adapted to include director elements is shown. As with FIGS. 7A and 7B discussed above; it should be appreciated that the illustration of FIG. 8 has been simplified to show only a single pole of each radiating branch.

According to a preferred embodiment, director 811 is tuned to an optimum length with respect to its driving element, radiating branch 311. The separation between director 811 and radiating branch 311 is also preferably optimized for maximum directivity. Similarly, director 801 is preferably tuned to an optimum length with respect to its driving element, radiating branch 301, The separation between director 801 and radiating branch 301 is also preferably optimized for maximum directivity.

Figure 8:
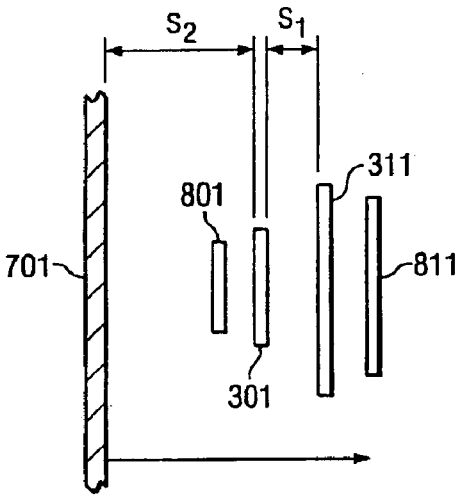
FIG. 8 shows a sub-reflector radiating branch configuration of multi-band antenna elements having director elements according to embodiments of the present invention.
Figure 9:
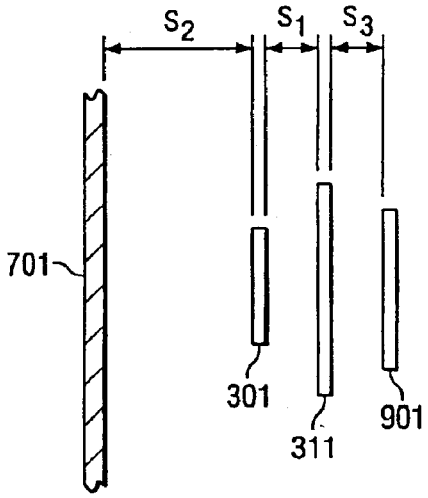
FIG. 9 shows another sub-reflector radiating branch configuration of multi-band antenna elements according to embodiments of the present invention.

It should be appreciated that the embodiment of FIG. 8, wherein director elements are utilized with respect to each operating band of the antenna element, provides increased antenna gain at both bands, as compared to the configuration of FIGS. 7A and 7B. Another advantage of the configuration of FIG. 8 is that the use of such director elements somewhat relaxes optimization constraints with respect to separation $S_2$ when the ratio of the frequencies of operation is larger than 2. Specifically, director element 801 allows $S_2$ to be slightly reduced to mitigate broadside cancellation of radiation associated with radiation branch 301, Although embodiments have been described above with reference to multi-band antenna element configurations having two differently configured radiating branches, e.g., dual-band configurations, the present invention is not limited to such configurations. For example, multi-band antenna elements of the present invention may provide triple-band configurations, using three different radiating branches as shown in FIG. 9. It should be appreciated that, although a preferred embodiment of the present invention provides a dipole antenna element configuration, the illustration of FIG. 9 has been simplified to show only a single pole of each radiating branch.

In the embodiment of FIG. 9, radiating branches 301 and 311, as well as reflector 701, are provided as discussed above with respect to FIG. 7. However, radiating branch 901, having a resonate frequency between the higher resonate frequency of radiating branch 301 and the lower resonate frequency of radiating branch 311, is disposed in front of, or above, radiating branch 311. In the configuration of FIG. 9, radiating branch 901 uses lower resonance radiating branch 311 as a reflector to obtain optimized radiation in the antenna broadside direction. Although the directivity of the broadside radiation associated with radiating branch 901 is directly affected by the separation $S_3$, reflector 701 used by radiating branches 301 and 311 has minimal effect with respect to radiating branch 901 of the illustrated embodiment.

It should be appreciated that alternative embodiments may be implemented differently than the multi-band antenna element configuration illustrated in FIG. 9. For example, highest frequency radiation branch 301 and mid frequency radiation branch 901 may be transposed with respect to lowest frequency radiation branch 311 according to one embodiment. Moreover, the particular bands associated with the radiating branches is not limited to that illustrated by FIG. 9. For example, rather than having a mid frequency associated with radiation branch 901, radiation branch 901 may be configured to have a same resonate frequency as that of radiating branch 301, such as to provide increased gain with respect to this band of operation and/or to provide signal diversity with respect to this band of operation, if desired.

Although not shown in FIG. 9 for simplicity, signal feed plates as described above are preferably utilized to couple various ones of the radiating branches, such as radiating branches 301 and 311 and/or radiating branches 311 and 901. Radiating branch 901 of one embodiment utilizes an antenna feed separate from that of radiating branches 301 and 311, such as to facilitate resonance frequencies which are spaced too closely together to be effectively integrated. Accordingly, where frequency separation between resonate frequencies of radiating branches 301 and 311 is on the order of 1.2 times, frequency separation between resonate frequencies of radiating branches 301 and 901 and/or 311 and 901 may be on the order of 0.5 times or less.

Figure 10A:
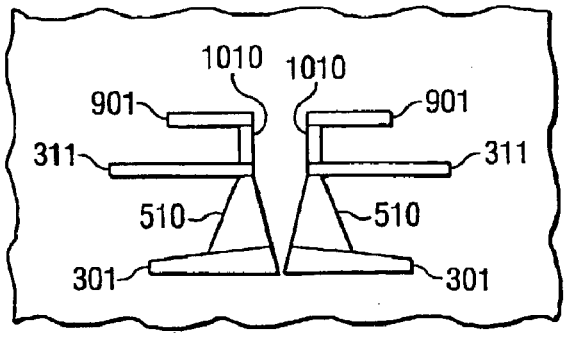
FIGS. 10A and 10B show a radiating branch configuration of FIG. 9 including signal feed plates and transmission lines according to embodiments of the present invention.
Figure 10B:
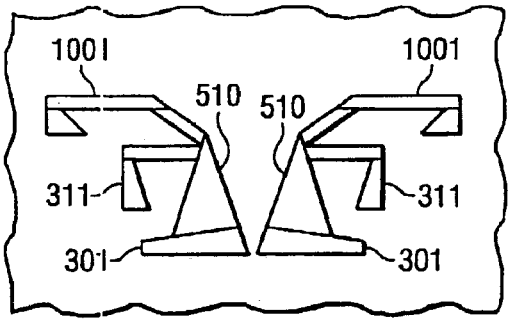

Directing attention to FIGS. 10A and 10B, embodiments of triple-band antenna element configurations having a single feed implementation are shown. In the embodiment of FIGS. 10A and 10B, radiating branches 301 and 311 are coupled using tapered bore signal feed plates 510 substantially as described above with respect to FIG. 5. Additionally, in the embodiment of FIGS 10A and 10B, radiating branches are disposed above radiating branches 311 to provide a third mode. The configuration shown in FIG. 10A includes series transmission lines 1010 coupling radiating branches 311 and 910, substantially as described above with respect to FIG. 9. The configuration shown in FIG. 10B is realized by including additional radiating branches 1001 on top of radiating branches 311, thereby forming a radiating branch having a much lower resonance frequency as compared to the above described radiating branches.

Figure 11A:
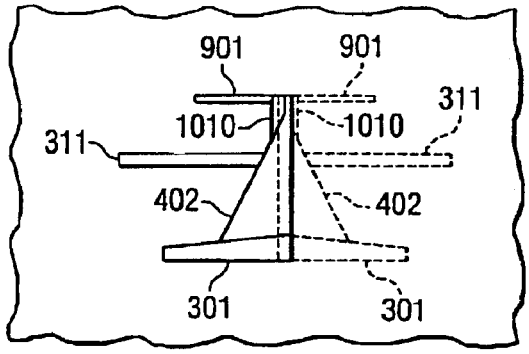
FIGS. 11A and 11B show a printed circuit board implementation of a multi-band antenna element, including signal feed plates, according to an embodiment of the present invention.
Figure 11B:
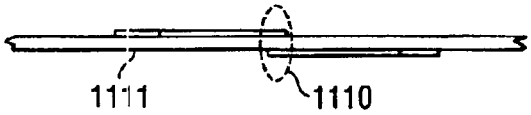
Figure 12A:
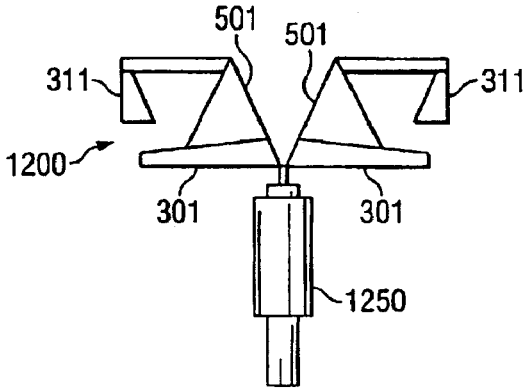
FIGS. 12A–12D show a corner reflector multi-band antenna configuration according to an embodiment of the present invention.
Figure 12B:
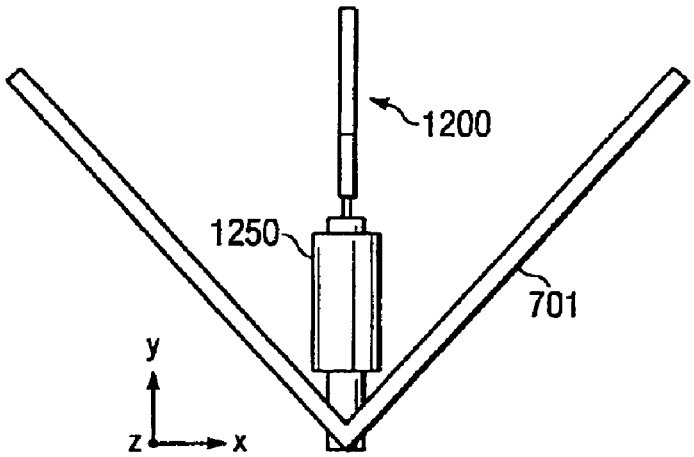
Figure 12C:
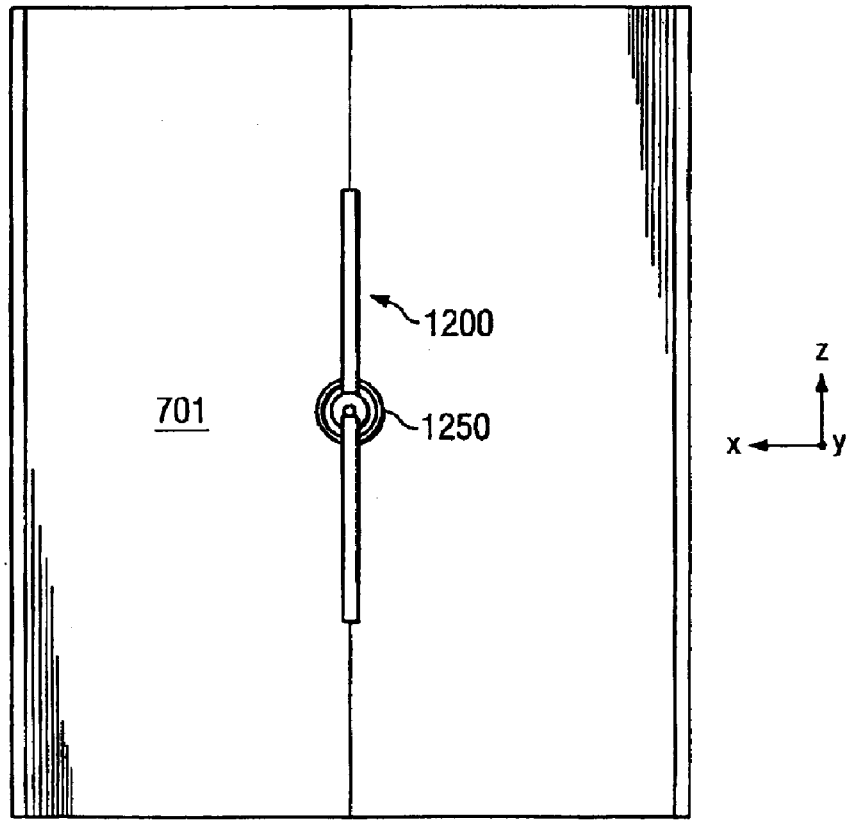
Figure 12D:
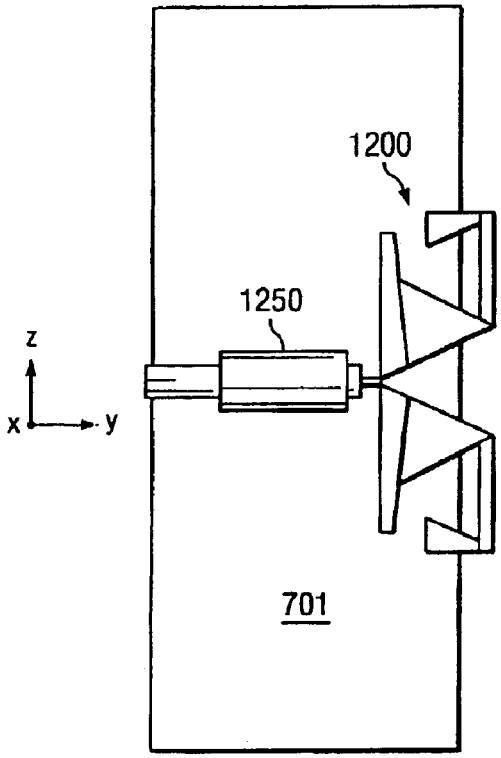

Another embodiment providing a single feed configuration is shown in FIGS. 11A and 11B. In the embodiment of FIGS. 11A and 11B, radiating branches 301, 311, and 901, signal feed plates 402, and serial transmission lines 1010 of each half of the dipole antenna are disposed upon opposite sides of dielectric substrate 1111, such as may comprise a PCB substrate. Radiating branches 301, 311, and 901, signal feed plates 402, and/or serial transmission lines 1010 are oriented in such a way as to create an overlap area, thereby defining wave guide 1110 as shown in FIG. 11B.

Waveguide 1110 of the illustrated embodiment guides the signal through the antenna element to the various radiating branches. It should be appreciated that electromagnetic waves propagating through waveguide 1110, having a dielectric material disposed therein, are slowed thereby allowing a smaller antenna element configuration. Another advantage associated with the configuration of the embodiment shown in FIGS. 11A and 11B is that a planar balun can be implemented on the PCB itself to provide a balanced feed to the dipole antenna element.

A prototype antenna implementing concepts of the present invention is shown in FIGS. 12A–12D. In the prototype configuration of FIGS. 12A–12D, multi-band dipole antenna element 1200 is feed by balun 1250 and disposed in front of reflector 710. It should be appreciated that the use of signal feed plates 501 in combination with folding radiating branches 311, antenna element 1200 is approximately 1.5 times smaller than a typical unloaded dipole antenna operable at the lowest operating frequency band of antenna element 1200.

The embodiment of FIGS. 12A–12D includes use of reflector 701 to provide a highly directional antenna, as well as to improve the impedance match between the radiating branches. In the illustrated embodiment, reflector 710 is folded to provide a corner reflector configuration. However, different configurations may be utilized according to alternative embodiments. For example, reflector 710 may comprise a strip like element, such as might be printed upon a same substrate as antenna element 1200, with a length larger than the lowest operating wavelength of the antenna element.

Figure 13:
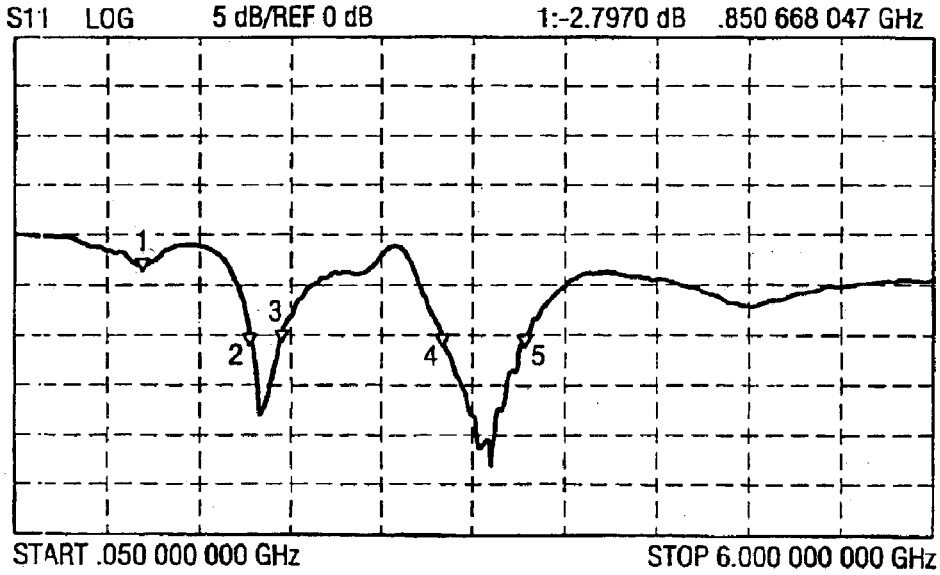
FIG. 13 shows a graph of the return signal loss of the corner reflector multi-band antenna configuration of FIGS. 12A–12D.

One embodiment of the prototype antenna configuration of FIGS. 12A–12D was configured to be responsive to 1.5 to 1.76 GHz (low band) and 2.8 to 3.36 GHz (high band) and the return loss was measured. FIG. 13 shows a graph of the measured return loss, illustrating the measured impedance bandwidth to be 12% and 15% for the low band and high band, respectively. The gain associated with each band, as measured, was approximately 7 dBi. Accordingly, both bands are provided approximately the same gain and the impedance bandwidth of each band is above 10% in the exemplary prototype antenna configuration.

Figure 14A:
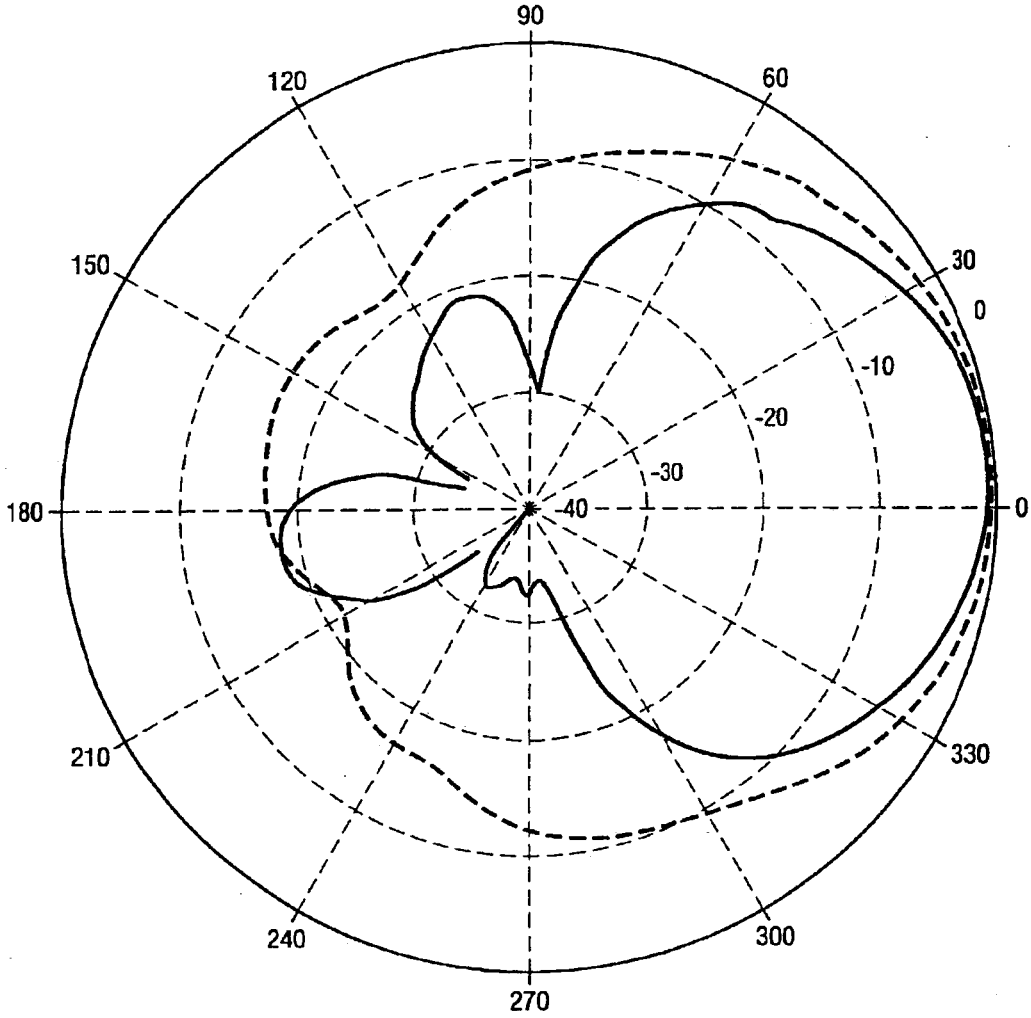
FIGS. 14A–14C show a plot of the radiation pattern of the corner reflector multi-band antenna configuration of FIGS. 12A–12D at various frequencies.
Figure 14B:
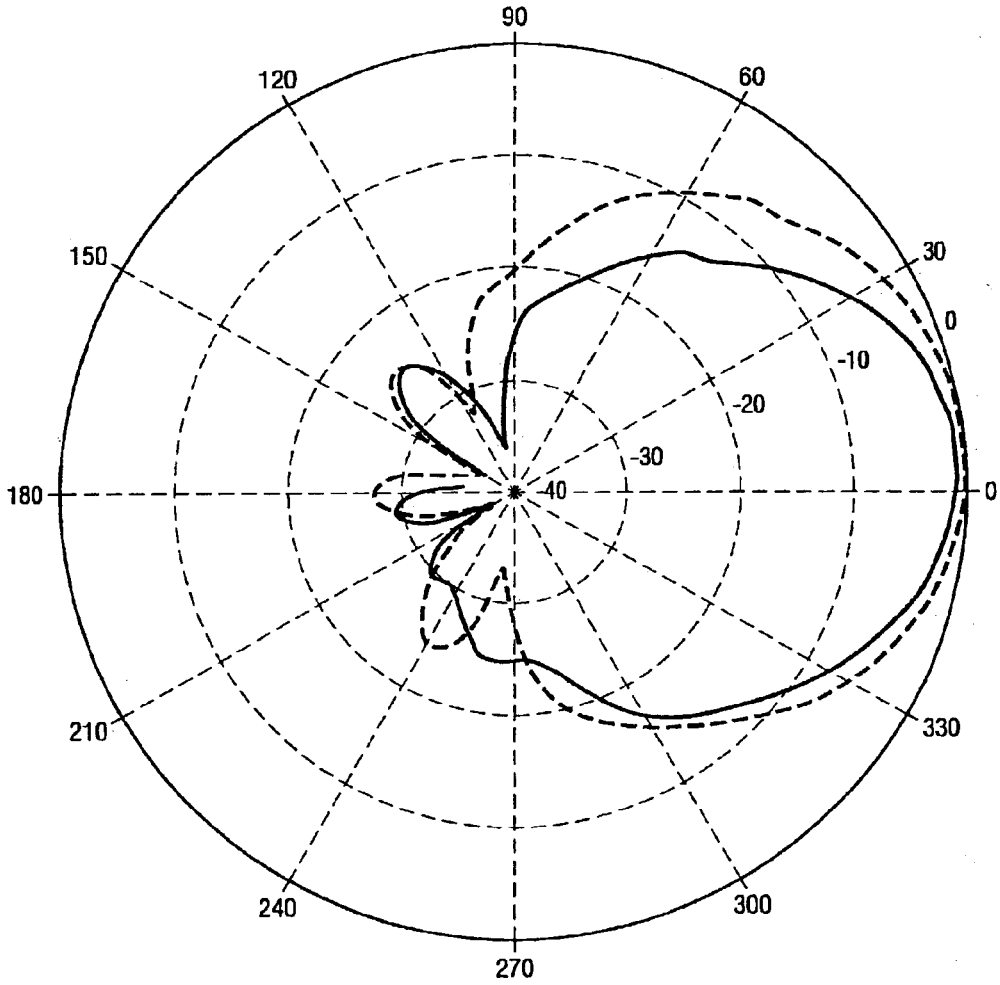
Figure 14C:
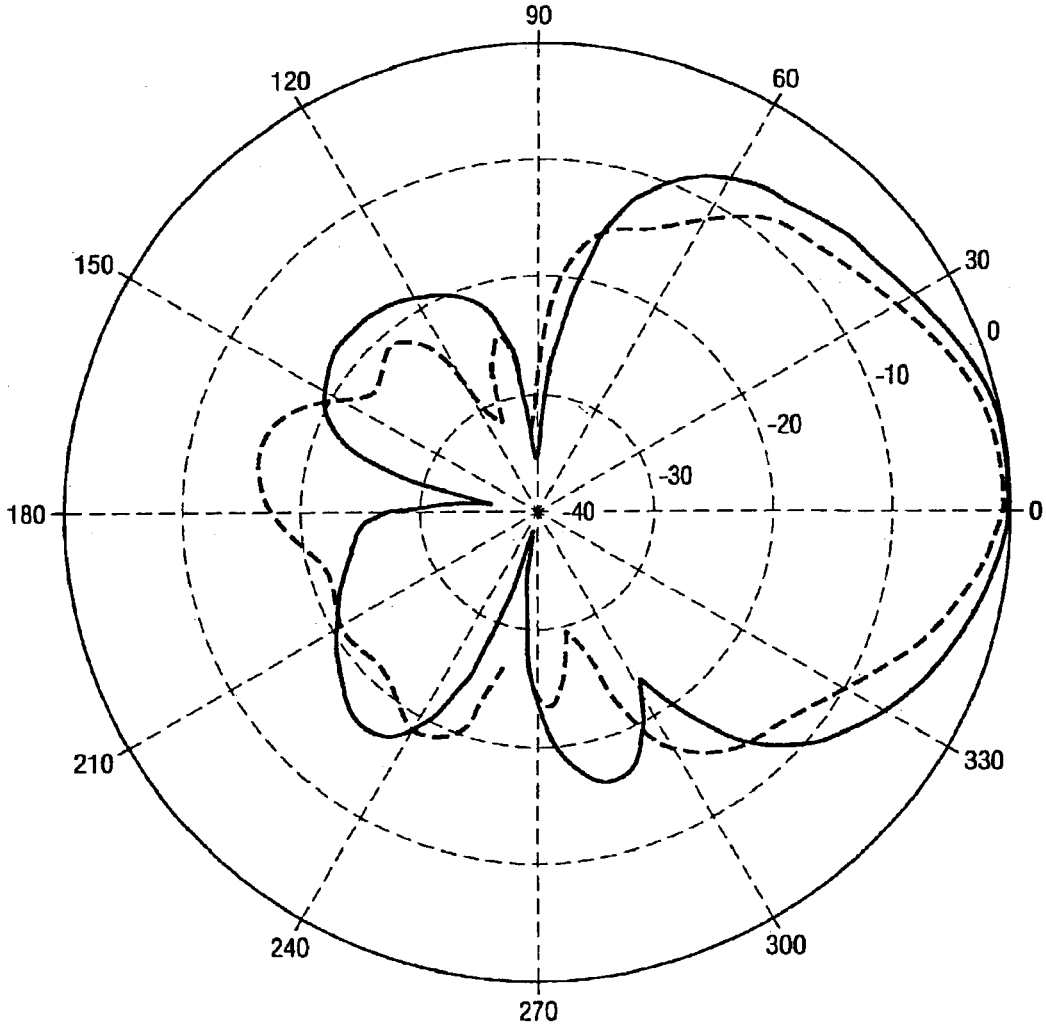

Another important characteristic is the resulting radiation or antenna pattern. FIGS. 14A–14C show the far field radiation pattern within the bands of the prototype antenna configured as discussed above. It should be appreciated that the radiation pattern for the low band and high band are approximately the same.

Although preferred embodiments have been described herein with reference to a dipole antenna element configuration, it should be appreciated that the concepts of the present invention are not limited to such a configuration. For example, monopole configurations, such as might be preferably for mobile terminals, may be implemented using one half (i.e., either the right or left half) of the antenna elements illustrated in FIGS. 4A–4E.

It should be appreciated that embodiments of the present invention are not limited to the radiating branch configurations shown. For example, embodiments of the present invention may utilize a tapered radiating branch, such as shown in FIG. 1, a bow tie radiating branch, a cylindrical radiating branch, etcetera.

Additionally, configurations providing different or multiple polarizations may be provided according to the present invention. For example, cross polarization may be provided by a configuration in which radiating branches are disposed orthogonally. According to one embodiment, cross polarization is provided by 4 radiating branches utilized for each band such that a pair of radiating branches is disposed substantially as shown in FIGS. 4A–4E and another pair of radiating branches is disposed rotated 90° about a central axis thereof to thereby provide vertical and horizontal polarization.

It should be appreciated that, although embodiments have been discussed above with respect to signal transmission by an antenna of the present invention, the concepts disclosed herein are applicable in both signal transmission and signal reception. Accordingly, multi-mode antenna elements of the present invention may be coupled to transmitters (signal generators), receivers, and/or transceivers as desired. Accordingly, "radiating branches" as utilized herein includes branches adapted for signal transmission, signal reception, and/or combinations thereof.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna element comprising:

a first radiating branch associated with a first resonant frequency band;

a second radiating branch associated with a second resonant frequency band;

a signal feed plate coupling said first radiating branch and said second radiating branch thereby providing a single signal feed with respect to said first and second radiating branches;

a reflector oriented such that said first radiating branch is disposed between said second radiating branch and said reflector, wherein said reflector comprises a folded surface having an axis of fold parallel to said first and second radiating branches.

2. The antenna element of claim 1, wherein an angle of said folded surface is approximately 45°.

3. An antenna element comprising:

a first radiating branch associated with a first resonant frequency band;

a second radiating branch associated with a second resonant frequency band;

a signal feed plate coupling said first radiating branch and said second radiating branch thereby providing a single signal feed with respect to said first and second radiating branches;

a reflector oriented such that said first radiating branch is disposed between said second radiating branch and said reflector, wherein a spacing $S_1$ of said first radiating branch from said reflector is in the range of approximately $0.25\lambda_1$ and $0.7\,\lambda_1$, wherein $\lambda_1$ is a characteristic wavelength of said first resonant frequency band, and a spacing $S_2$ of said second radiating branch from said reflector is in the range of approximately $0.25\lambda_2$ and $0.7\,\lambda_2$ wherein $\lambda_2$ is a characteristic wavelength of said second resonant frequency band, wherein spacing $S_1$ is determined as a function of $S_2$ according to the equation:

$$S_1 = x\left\{\frac{\lambda_2}{2} - \left(S_2 + \frac{\lambda_1}{2}\right)\right\} + \frac{\lambda_1}{2}.$$

4. An antenna element comprising:

a first radiating branch associated with a first resonant frequency band;

a second radiating branch associated with a second resonant frequency band;

a signal feed plate coupling said first radiating branch and said second radiating branch thereby providing a single signal feed with respect to said first and second radiating branches;

a reflector oriented such that said first radiating branch is disposed between said second radiating branch and said reflector;

a third radiating branch associated with a third resonant frequency band, wherein said first and second radiating branches are disposed between said third radiating branch and said reflector; and a signal transmission line coupled to said third radiating branch electrically isolated from said signal feed plate.

5. The antenna element of claim 4, wherein said third resonant frequency is greater than said first resonant frequency and less than said second resonant frequency.

6. The antenna element of claim 4, wherein said third resonant frequency is less than said first and second resonant frequencies.

7. The antenna element comprising:

a signal transmission line coupling said third radiating branch to said second radiating branch.

8. The antenna element of claim 4, further comprising:

a signal feed plate coupling said third radiating branch to said second radiating branch.

9. The antenna element of claim 4, wherein said antenna element provides multi-band operation in which a first band of said multi-band operation corresponds to said first resonant frequency band, a second band of said multi-band operation corresponds to said second resonant frequency band, and a third band of said multi-band operation corresponds to said third resonant frequency band.

10. The antenna element of claim 4, wherein said antenna element provides wideband operation in which a first edge of said wideband operation corresponds to one of said first and third resonant frequency bands and a second edge of said wideband operation corresponds to said-second resonant frequency band.

11. The antenna element of claim 4, wherein said antenna element provides wideband operation in which a first edge of said wideband operation corresponds to said first resonant frequency band and a second edge of said wideband operation corresponds to said second resonant frequency band.

12. A method for providing an antenna element comprising:

coupling a first radiating branch associated with a first resonant frequency band to a second radiating branch associated with a second resonant frequency band using a signal feed plate, said signal toed plate providing a single signal feed with respect to said first and second radiating branches; and providing a reflector surface such that said first radiating branch is disposed between said second radiating branch and said reflector surface;

folding said reflector surface along an axis parallel to said first and second radiating branches to thereby provide a corner reflector configuration.

13. A method for providing an antenna element comprising:

coupling a first radiating branch associated with a first resonant frequency band to a second radiating branch associated with a second resonant frequency band using a signal feed plate, said signal feed plate providing a single signal feed with respect to said first and second radiating branches, wherein said signal feed plate has a relatively large surface area when compared to surface areas of the first and second radiating branches and;

providing a reflector surface such that said first radiating branch is disposed between said second radiating branch and said reflector surface, wherein said first resonant frequency is greater than said second resonant frequency, and wherein said second radiating branch operates as a sub-reflector with respect to said first radiating branch; and providing a third radiating branch on a side of said second radiating branch opposite said first radiating branch, wherein said third radiating branch is coupled to a signal feed transmission line isolated from said first and second radiating branches.

14. The method of claim 13, wherein said third radiating branch is associated with a third resonant frequency.

15. The method of claim 14, wherein said third resonant frequency is between said first and second resonant frequencies.

16. The method of claim 14, wherein said first resonant frequency is between said second and third resonant frequencies.

17. The method of claim 13, wherein said third radiating branch is associated with said first resonant frequency.

18. The method of claim 13, further comprising:

coupling said second radiating branch and said third radiating branch using a transmission line.

19. The method of claim 13, further comprising:

coupling said second radiating branch and said third radiating branch using another signal feed plate.

20. A method for providing an antenna element comprising:

coupling a first radiating branch associated with a first resonant frequency band to a second radiating branch associated with a second resonant frequency band using a signal feed plate, said signal feed plate providing a single signal feed with respect to said first and second radiating branches, wherein said signal feed plate has a relatively large surface area when compared to surface areas of the first and second radiating branches; and providing a first director associated with said first radiating branch;

providing a second director associated with said second radiating branch, wherein said first and second radiating branches are disposed between said first and second directors.

21. A dipole antenna system comprising:

a first dipole element associated with a first frequency band;

a second dipole element associated with a second frequency band, wherein said second dipole element is oriented parallel to said first dipole element, and wherein said first frequency band is wider than said second frequency band; and a reflector providing reflection of both said first frequency band and said second frequency band, wherein said first dipole element is disposed between said second dipole element and said reflector, wherein said first dipole element comprises first and second radiating branches and said second dipole element comprises third and fourth radiating branches, said system further comprising:

a first signal feed plate coupling said first and third radiating branches; and a second signal feed plate coupling said second and fourth radiating branches, wherein said first and second signal feed plates are triangular.

22. The system of claim 21, wherein said triangular signal feed plates are disposed to provide a tapered bore between said first and third radiating branches on one side of said bore and said second and fourth radiating branches on another side of said bore.

23. The system of claim 22, wherein said tapered bore provides decoupling of signals.

24. The system of claim 22, wherein said tapered bore provides a frequency independent mode of operation.

25. The system of claim 21, wherein said first dipole element, said second dipole element, said first signal feed plate, and said second signal feed plate are disposed upon a dielectric substrate.

26. The system of claim 25, wherein said first and third radiating branches and said first signal feed plate are disposed on a first side of said dielectric substrate, and wherein said second and fourth radiating branches and said second signal feed plate are disposed on a second side of said dielectric substrate.

27. The system of claim 21, further comprising:

a third dipole element associated with a third frequency band, wherein said third dipole element is oriented parallel to said first and second dipole elements, and wherein said first and second dipole elements are disposed between said third dipole element and said reflector.

28. The system of claim 27, wherein said third frequency band is between said first frequency band and said second frequency band.

29. The system of claim 27, wherein said first frequency band is between said second frequency band and said third frequency band.

30. A dipole antenna system comprising:

a first dipole element associated with a first frequency band;

a second dipole element associated with a second frequency band, wherein said second dipole element is oriented parallel to said first dipole element, and wherein said fist frequency band is wider than said second frequency band;

a reflector providing reflection of both said first frequency band and said second frequency band, wherein said first dipole element is disposed between said second dipole element and said reflector, wherein said first dipole element comprises first and second radiating branches and said second dipole element comprises third and fourth radiating branches;

a first signal feed plate coupling said first and third radiating branches;

a second signal feed plate coupling said second and fourth radiating branches; and a first director element associated with said first frequency band, wherein said first director element is oriented parallel to said first dipole element and is disposed between said first dipole element and said reflector.

31. The system of claim 30, further comprising:

a second director element associated with said second frequency band, wherein said second dipole element is oriented parallel to said second director and is disposed between said second director element and said reflector.

* * * * *